US006857927B2

(12) United States Patent
Miwa et al.

(10) Patent No.: US 6,857,927 B2
(45) Date of Patent: Feb. 22, 2005

(54) METHOD OF SECURING SHADOW MASK AND FRAME IN THE MANUFACTURE OF A CATHODE RAY TUBE

(75) Inventors: Kiyohito Miwa, Ikoma (JP); Toshifumi Nakatani, Moriguchi (JP); Tutomu Utsumi, Kyoto (JP)

(73) Assignee: Matsushita Electric Industrial Co., Ltd., Oaska (JP)

( * ) Notice: Subject to any disclaimer, the term of this patent is extended or adjusted under 35 U.S.C. 154(b) by 1 day.

(21) Appl. No.: 10/311,028

(22) PCT Filed: Apr. 10, 2002

(86) PCT No.: PCT/JP02/03565

§ 371 (c)(1),
(2), (4) Date: Dec. 10, 2002

(87) PCT Pub. No.: WO02/084690

PCT Pub. Date: Oct. 24, 2002

(65) Prior Publication Data

US 2003/0171061 A1 Sep. 11, 2003

(30) Foreign Application Priority Data

Apr. 13, 2001 (JP) ..... 2001-115041

(51) Int. Cl.[7] ..... H01J 9/12; H01J 29/80; H01J 9/236; H01J 9/00; H01J 9/24

(52) U.S. Cl. ..... 445/47; 445/30; 445/24; 445/25

(58) Field of Search ..... 313/402, 404, 313/407; 445/30

(56) References Cited

U.S. PATENT DOCUMENTS

| | | | | |
|---|---|---|---|---|
| 4,828,523 A | * | 5/1989 | Fendley et al. | 445/30 |
| 4,828,524 A | | 5/1989 | Fendley | |
| 4,834,686 A | * | 5/1989 | Kautz et al. | 445/30 |
| 6,139,387 A | | 10/2000 | Kimura et al. | |
| 6,469,431 B1 | * | 10/2002 | Suzuki et al. | 313/407 |

FOREIGN PATENT DOCUMENTS

| | | |
|---|---|---|
| EP | 0 984 482 | 3/2000 |
| JP | 7-211229 | 8/1995 |
| JP | 2000-77007 | 3/2000 |

* cited by examiner

*Primary Examiner*—Joseph Williams
*Assistant Examiner*—Matt Hodges
(74) *Attorney, Agent, or Firm*—Merchant & Gould P.C.

(57) ABSTRACT

A welding route of welding a color selecting electrode to a frame is as follows: first of all, a welding head moves down onto one end portion of a long frame side (Step I), welding is conducted from the end portion toward a center portion of the long frame side (Step II). Then, after moving up once (Step III), the welding head moves horizontally toward the other end portion of the long frame side (Step IV) and moves down onto the long frame side (Step V), and welding is conducted from the other end portion toward a center portion of the long frame side (Step VI). Finally, the welding head retracts (Step VII). With this welding route, the generation of wrinkles in the vicinity of the end portions of the long sides of the color selecting electrode can be suppressed.

2 Claims, 5 Drawing Sheets

METHOD OF SECURING SHADOW MASK AND FRAME IN THE MANUFACTURE OF A CATHODE RAY TUBE

TECHNICAL FIELD

The present invention relates to a method of manufacturing a cathode ray tube for use in a television set, a computer display and the like.

BACKGROUND ART

Conventionally, as a method of manufacturing a color selection mechanism for use in cathode ray tubes, JP 7(1995)-211229 A, for example, describes a method of welding a color selecting electrode to a frame, where the color selecting electrode includes an aperture grill provided with a plurality of parallel and vertical slits formed in a metal sheet. FIGS. 7A and 7B show a welding route during the welding process.

The color selecting electrode including the aperture grill is welded only to long frame sides 1 of a frame 3 made up of the long frame sides 1 and short frame sides 2. The welding route includes the following steps as shown in FIGS. 7A and 7B: a welding head moves down onto a center portion of the long frame side 1 (Step I), welding is conducted from the center portion toward one end of the long frame side 1 (Step II) followed by a step where the welding head moves up once (Step III), the welding head moves horizontally toward a center portion of the long frame side 1 (Step IV) followed by a step where the welding head moves down onto the long frame side 1 (Step V), welding is conducted from the center portion toward the other end of the long frame side 1 (Step VI), and the welding head retracts (Step VII) so as to complete the welding of the color selecting electrode to the frame 3.

However, in the case of applying this welding method to a tension-type shadow mask as described in JP 2000-77007 A where a tensile force parallel to a short side direction of a frame is applied to a shadow mask (color selecting electrode) and a tensile distribution is required for a long side direction of the frame so that a tensile force at a center portion is larger than a tensile force at an end portion, the following problem would occur: that is, the welding of the color selecting electrode to the frame with the conventional welding method described in JP 7-211229 A causes the concentration of a distortion in the color selecting electrode, which is generated due to welding heat, at a termination part of the welding route. Therefore so-called wrinkles are generated in the vicinity of the end portions of the long side direction of the color selecting electrode, which correspond to the termination of the welding route, thus deteriorating a picture quality of the cathode ray tube.

DISCLOSURE OF THE INVENTION

In view of the above-stated problem, it is an object of the present invention to provide a cathode ray tube manufacturing method, which can suppress the generation of wrinkles in a color selecting electrode. More particularly, it is an object of the present invention to provide a cathode ray tube manufacturing method, which can suppress the generation of wrinkles in the vicinity of end portions of long side direction of a color selecting electrode in a cathode ray tube in which a desired tensile force is applied to the color selecting electrode and a tensile distribution is required for a long side direction so that a tensile force at a center portion is larger than a tensile force at an end portion.

To fulfill the above-stated object, a cathode ray tube manufacturing method according to the present invention includes the step of welding a color selecting electrode to two opposite sides of a frame along a predetermined welding route. In this method, a termination of the welding route is located at a center portion of each of the two sides. With this method, when welding the color selecting electrode to the frame, the generation of wrinkles in the color selecting electrode can be suppressed, thus preventing a deterioration of a picture quality of the cathode ray tube, such as color displacement in the image. Even when wrinkles were generated in the color selecting electrode, the wrinkles could be positioned at a center portion of the side of the frame where a deflection angle of an electron beam is small. Consequently, compared with the case where wrinkles were generated in the vicinity of the end portions of the side of the frame where a deflection angle of an electron beam is large, the shifting amount of a position of an aperture in the color selecting electrode along the deflection direction of the electron beam, generated due to the wrinkles, could be reduced, thus suppressing the shifting in the landing position of the electron beam. Thereby, factors that deteriorate a picture quality, such as color displacement in an image, can be reduced.

In addition, since the termination of the welding route for welding the color selecting electrode to the frame is located at a center portion of the side to be welded, a distortion generated in a color selecting electrode, to which a tensile force is applied so as to become the largest at the center portion of the side, can be lessened by such a tensile force. This can suppress the shifting in the landing position of the electron beam and therefore can reduce factors that deteriorate a picture quality, such as color displacement in an image.

BRIEF DESCRIPTION OF DRAWINGS

FIG. 1A is a plan view and FIG. 1B is a side view.

FIG. 7A is a plan view and FIG. 7B is a side view.

BEST MODE FOR CARRYING OUT THE INVENTION

The following describes one embodiment of the present invention, with reference to the drawings.

Figure 1A:
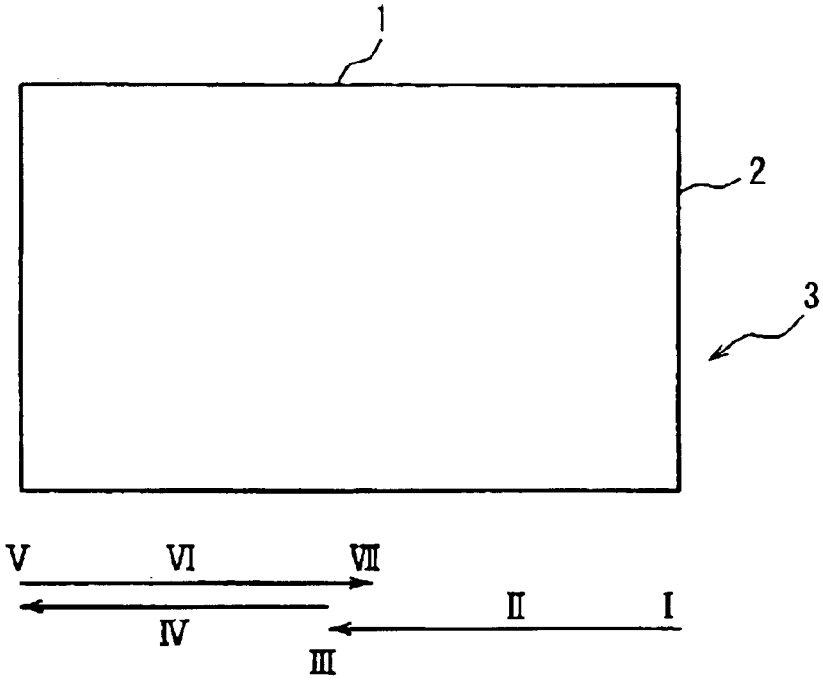
FIGS. 1A and 1B show a welding route of a color selecting electrode according to one embodiment of the present invention, where
Figure 1B:
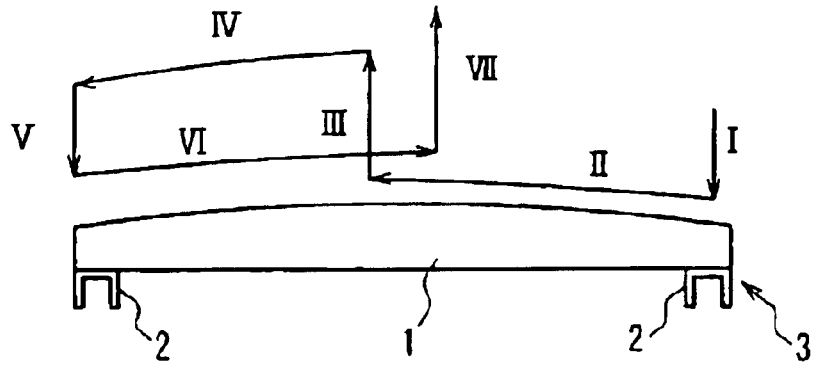

FIGS. 1A and 1B show a welding route of welding a shadow mask (color selecting electrode) to a frame according to a cathode ray tube manufacturing method of the present invention. FIGS. 2A to 2C and FIGS. 3A to 3C are perspective views showing a process of welding a color selecting electrode to a frame, which is conducted in the order presented. The shadow mask is welded to two opposite sides of the frame, only to long sides in the present case.

FIG. 1A illustrates an outline of a frame 3 made up of long frame sides 1 and short frame sides 2 as viewed from a top face thereof. FIG. 1B is a side view of the frame 3. I to VII denote each step number of the welding route for welding the shadow mask to the frame 3, where a welding head moves from step I in ascending order. The color selecting electrode is welded while applying a load to the long frame sides 1 in a direction to make the long frame sides 1 curve toward the inside.

When welding the shadow mask to the frame 3, as shown in FIGS. 1A and 1B, first of all, the welding head moves down onto one end portion of the long frame side 1 (Step I), welding is conducted from the end portion toward a center portion of the long frame side 1 (Step II). Then, after moving up once (Step III), the welding head moves horizontally toward the other end portion of the long frame side 1 (Step IV) and moves down onto the long frame side 1 (Step V), and welding is conducted from the other end portion toward a center portion of the long frame side 1 (Step VI). Finally, the welding head retracts (Step VII). In this way, a starting point of the welding route is located at an end portion of the long frame side 1, and a termination of the welding route is located at a center portion of the long frame side 1.

Note here that the welding route is set so that a welded portion in Step II and a welded portion in Step VI partially overlap each other, e.g., a terminal portion in Step II and a terminal portion in Step VI overlap approximately 1 mm in the direction along the welding route. This ensures that welding is conducted over the entire side.

Figure 2A:
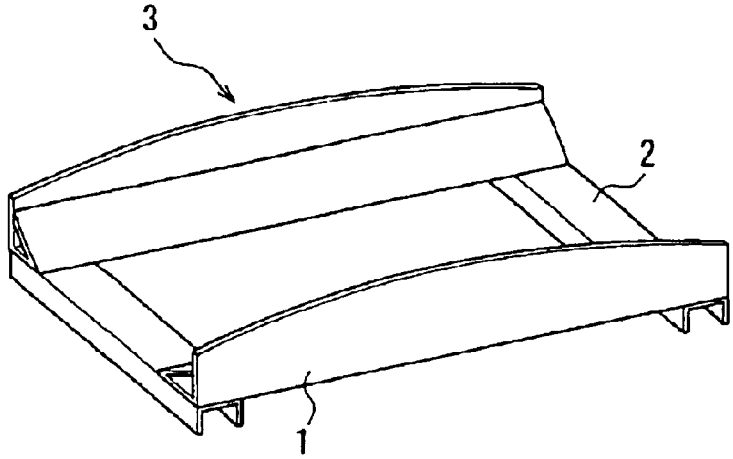
FIGS. 2A to 2C are perspective views showing a welding process of a shadow mask, which is conducted in the order presented.
Figure 2B:
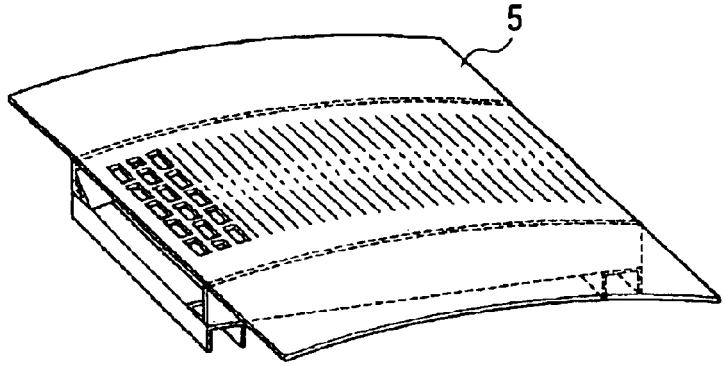
Figure 2C:
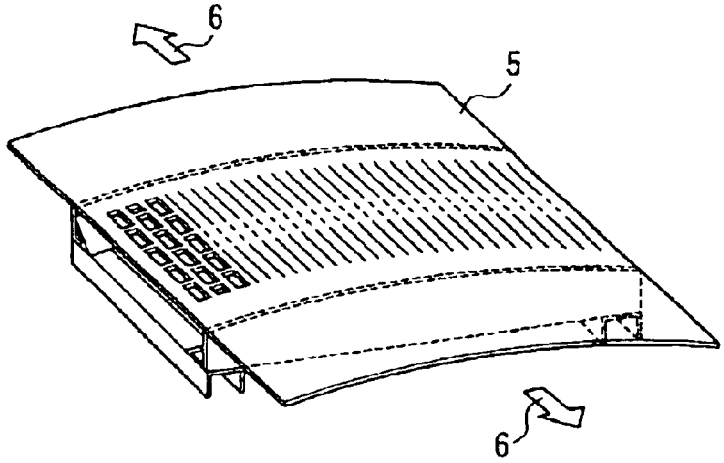

A process of welding the shadow mask will be described in the following, referring to FIGS. 2A to 2C and FIGS. 3A to 3C. First of all, a frame 3 made up of long frame sides 1 and short frame sides 2 is prepared (FIG. 2A). On the frame 3, a mask plate 5 to be processed as a shadow mask 4 (See FIG. 3C), namely a color selecting electrode provided with rectangular mask apertures, is mounted (FIG. 2B). In order to remove the waviness in the shadow mask 4 under tension and to apply a desired tensile force to the shadow mask 4, a tensile force 6 in a direction parallel to the short frame side 2 is applied to the mask plate 5 (FIG. 2C).

Figure 3A:
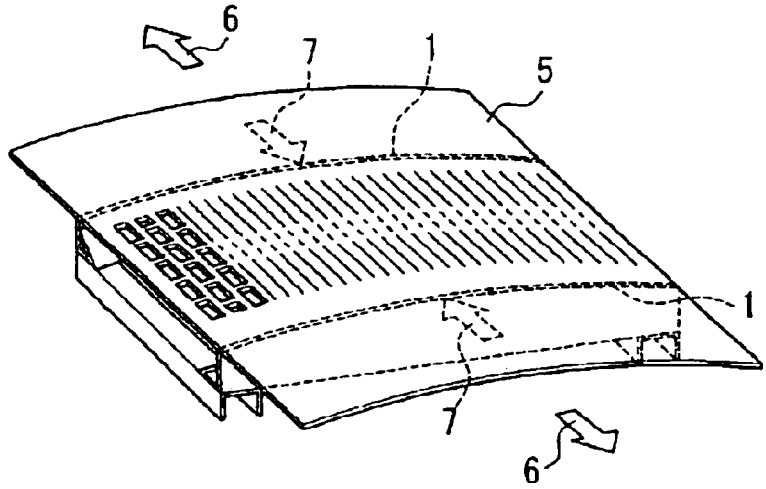
FIGS. 3A to 3C are perspective views showing a welding process of a shadow mask, which is conducted in the order presented.

Next, while applying the tensile force 6 to the mask plate 5, a desired compressive force 7 is applied to opposite long frame sides 1 of the frame 3 so as to deform the frame 3 (FIG. 3A). The compressive force 7 is set so that the amount of compressive deformation is greater at a center portion than end portions of the long frame sides 1. For instance, in the case where the shape of the frame 3 before being applied the compressive force 7 is rectangular, then the compressive force 7 is applied so that the shape of the frame 3 is deformed into an hourglass shape.

Figure 3B:
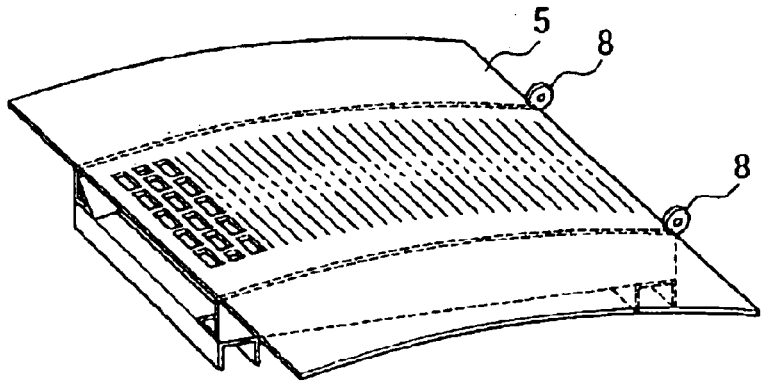

In this way, while applying the tensile force 6 and the compressive force 7 to the mask plate 5 and the long frame sides 1, respectively, the mask plate 5 and the long frame sides 1 are welded and bonded by means of a welding roller 8 (FIG. 3B). In this step, the welding is conducted along the welding route described referring to FIGS. 1A and 1B. In this embodiment, the welding is conducted with a resistance welding method, where the welding roller 8 functions as an electrode in the resistance welding method. However, naturally, the welding in the present invention can be conducted with methods other than the resistance welding method.

Figure 3C:
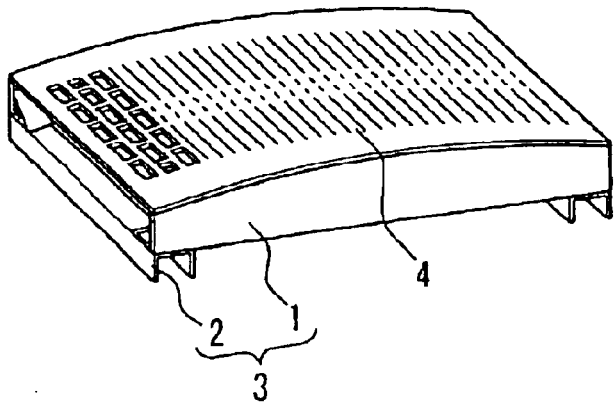

Subsequently, the tensile force 6 and the compressive force 7 are released and unnecessary portions of the mask plate 5 are trimmed, so that a shadow mask structure (color selecting electrode structure) configured with the shadow mask 4 welded to the frame 3 can be obtained (FIG. 3C). By the tensile force 6 that was applied to the mask plate 5 and a restoring force of the long frame sides 1 deformed by the compressive force 7, a desired tensile force is applied to the shadow mask 4 in the direction parallel to the short side and a tensile distribution becomes such that a tensile force acting at the center portion of the long side direction of the shadow mask 4 is larger than a tensile force acting at the end portions thereof. Note here that although this embodiment deals with the case where the welding is conducted while applying the tensile force 6 and the compressive force 7 to the mask plate 5 and the long frame sides 1, respectively, the welding may be conducted while applying any one of the tensile force 6 and the compressive force 7.

Using the thus obtained shadow mask structure, a cathode ray tube can be completed using a normal manufacturing method for the other processes.

As stated above, when welding the shadow mask 4 to two opposite sides (long frame sides 1) of the frame 3, the welding starts from an end portion of each of the two sides and terminates at a center portion of each of the two sides, whereby the generation of wrinkles in the shadow mask can be suppressed. Accordingly, a deterioration of a picture quality of the cathode ray tube, such as color displacement in the image, can be avoided.

In addition, even when wrinkles were generated in the shadow mask 4 because the thermal expansion due to welding heat is larger in the shadow mask 4 than in the frame 3, the wrinkles could be positioned at a center portion in the long side direction where a deflection angle of an electron beam is small. Consequently, compared with the case where wrinkles were generated in the vicinity of the end portions in the long side direction of the frame 3 where a deflection angle of an electron beam is large, the shifting amount of a position of an aperture in the shadow mask along the deflection direction of the electron beam, generated due to the wrinkles, could be reduced, thus suppressing the shifting in the landing position of the electron beam. Thereby, factors that deteriorate a picture quality, such as color displacement in an image of the cathode ray tube, can be reduced.

Furthermore, by terminating the welding route at the center portion in the long side direction of the shadow mask 4, on which a larger tensile force acts, a distortion generated in the shadow mask 4 can be lessened by such a larger tensile force. This can suppress the shifting in the landing position of the electron beam due to the wrinkles in the shadow mask 4 and therefore can reduce factors that deteriorate a picture quality, such as color displacement in an image of the cathode ray tube.

Next, the following describes the results of experiments to confirm these effects. After subjecting shadow mask structures obtained by using the welding method of the present invention described referring to FIGS. 1A and 1B, FIGS. 2A to 2C and FIGS. 3A to 3C and shadow mask structures obtained by using the conventional welding method shown in FIGS. 7A and 7B to a heat treatment, wrinkles generated in the shadow masks included in these shadow mask structures were measured. The measurement results will be shown in FIGS. 4 to 6. The horizontal axis of each of these drawings indicates grades of estimated wrinkles (hereinafter called "wrinkle grade"), and the vertical axis indicates frequency of each wrinkle grade. As for the wrinkle grade, the grade 5 is entirely satisfactory, the grades 2 or less indicate defectives in terms of actual products, and the grades between 3 and 5 indicate conforming items. The significance of these wrinkle grades was confirmed by determining conforming items and defectives of the shadow masks, based on the results of estimating picture qualities of cathode ray tubes that were produced separately using the shadow masks that have been ranked as each wrinkle grade.

Figure 4:
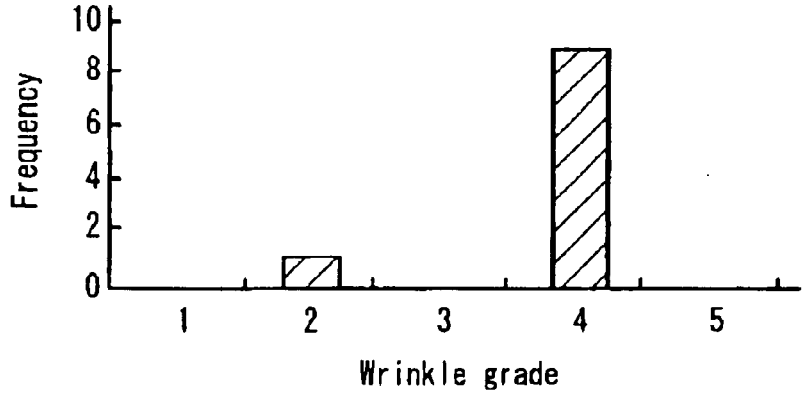
FIG. 4 shows a generation status of wrinkles in shadow mask structures obtained with the welding method according to the present invention.
Figure 5:
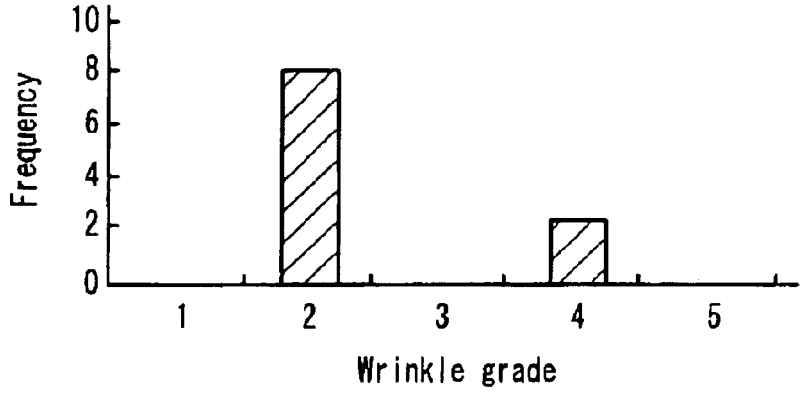
FIG. 5 shows a generation status of wrinkles in shadow mask structures obtained with the conventional welding method.

FIG. 4 shows the results obtained by using the welding method of the present invention, and FIG. 5 shows the results obtained by using the conventional welding method. The number of test samples was 10 in each case. As is evident from FIGS. 4 and 5, according to the welding method of the present invention, one of ten samples was a wrinkle defective, so that the percentage of wrinkle defectives was 10%, while according to the conventional welding method, eight of ten samples were wrinkle defectives, so that the percentage of wrinkle defectives was 80%. Thus, according to the welding method of the present invention, the percentage of wrinkle defectives could be improved considerably.

Figure 6:
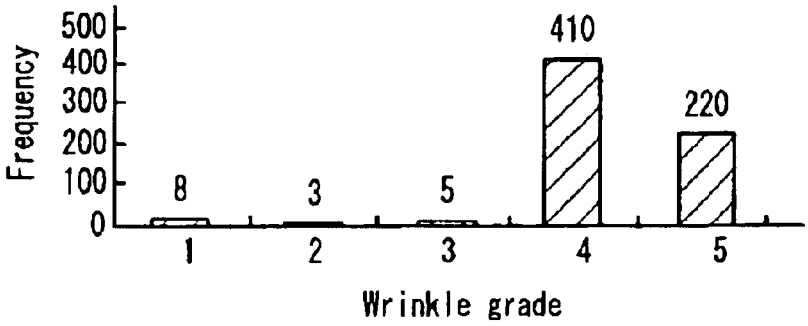
FIG. 6 shows a generation status of wrinkles in shadow mask structures obtained with the welding method according to the present invention, when the number of test samples is increased.
Figure 7A:
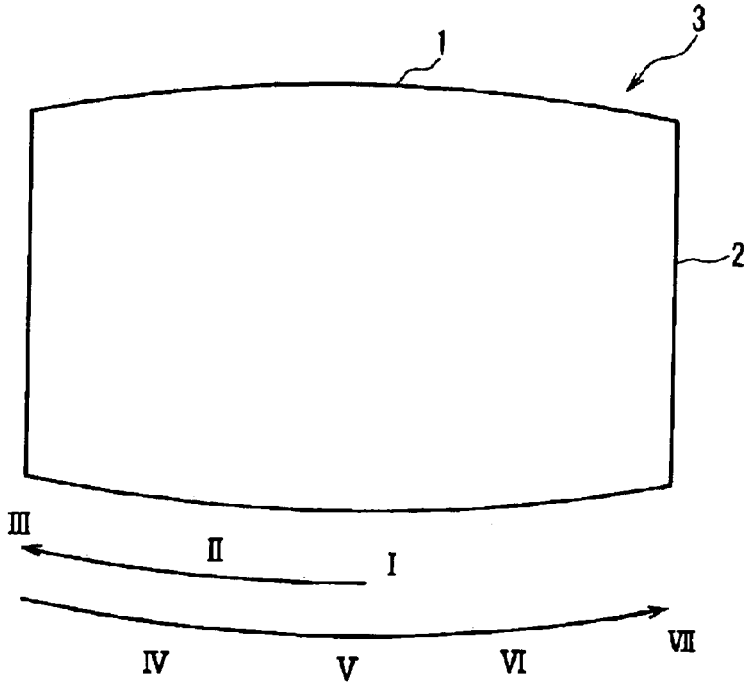
FIG. 7A PRIOR ART
FIGS. 7A and 7B show a welding route of a color selecting electrode according to the conventional method, where
Figure 7B:
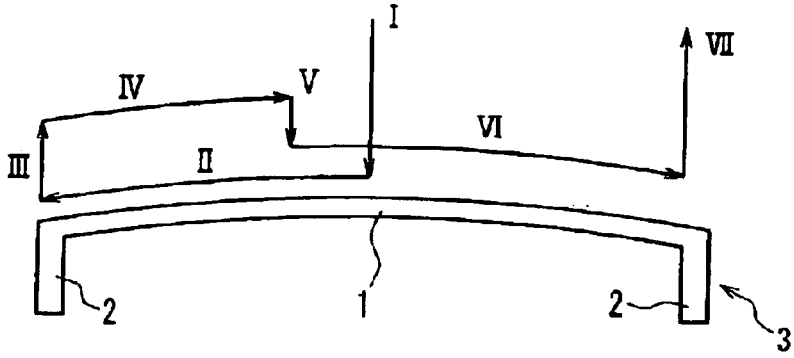
FIG. 7B PRIOR ART

FIG. 6 shows the results confirming the effectiveness of the welding method of the present invention, by increasing the number of test samples. 646 shadow mask structures were produced on an experimental basis, and wrinkles generated in these shadow masks were estimated. As a result, the number of wrinkle defectives with a wrinkle grade of 2 or less was 11, so that the percentage of wrinkle defectives was 1.7%. Accordingly, it can be found that the welding method of the present invention can realize a significantly low defective percentage.

Note here that although the above-described embodiment deals with the case where the shape of the frame 3 before being subjected to the compressive force is rectangular, the present invention is applicable to the case where the shape of the frame 3 before being subjected to the compressive force is a shape where a distance between opposite long frame sides 1 is longer at a center portion than at end portions, or conversely a shape where the distance between opposite long frame sides 1 is shorter at a center portion than at end portions.

Additionally, although the above-described embodiment deals with the case where the color selecting electrode is welded to a pair of long frame sides, the present invention is applicable to the case where the color selecting electrode is welded to a pair of short frame sides.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method of manufacturing a cathode ray tube, comprising the step of welding a color selecting electrode to a first and a second two opposite sides of a frame along a predetermined welding route, wherein a termination of the welding route is located at a center portion of each of the first and the second sides, the welding is conducted from one end portion of the first side toward the center portion of the first side, and after moving a welding head toward the other end portion of the first side, the welding is conducted from the other end portion of the first side toward the center portion of the first side, and the welding is conducted from one end portion of the second side toward the center portion of the second side, and after moving the welding head toward the other end portion of the second side, the welding is conducted from the other end portion of the second side toward the center portion of the second side.

2. The method of manufacturing a cathode ray tube according to claim 1, wherein the color selecting electrode is welded to the frame in such a manner that a tensile force acting on the color selecting electrode after welding to the frame is larger at a center portion than at end portions of each of the sides.

* * * * *